US006045494A

United States Patent [19]

Toyama

[11] Patent Number: 6,045,494

[45] Date of Patent: Apr. 4, 2000

[54] CENTRIFUGAL SEPARATING METHOD AND CENTRIFUGAL MACHINE

[75] Inventor: Masami Toyama, Kawaguchi, Japan

[73] Assignee: Tomy Seiko Co., Ltd., Tokyo, Japan

[21] Appl. No.: 08/890,652

[22] Filed: Jul. 8, 1997

[30] Foreign Application Priority Data

Jul. 9, 1996 [JP] Japan ..... 8-198405

[51] Int. Cl.[7] ..... B04B 5/02

[52] U.S. Cl. ..... 494/16; 494/37

[58] Field of Search ..... 494/16, 17, 20, 494/33, 37, 85; 422/72

[56] References Cited

U.S. PATENT DOCUMENTS

| | | | |
|---|---|---|---|
| 486,390 | 11/1892 | Berg | 494/20 |
| 3,050,239 | 8/1962 | Williams, Jr. | 494/16 |
| 3,905,772 | 9/1975 | Hartnett et al. | 494/16 |
| 5,199,937 | 4/1993 | Wada et al. | 494/20 |
| 5,538,493 | 7/1996 | Gerken et al. | 494/16 |
| 5,683,659 | 11/1997 | Hovatter | 422/72 |
| 5,707,331 | 1/1998 | Wells et al. | 494/20 |

FOREIGN PATENT DOCUMENTS

| | | | |
|---|---|---|---|
| 2910868 | 10/1980 | Germany | 494/20 |
| 53-16969 | 2/1978 | Japan | 494/20 |

*Primary Examiner*—Charles E. Cooley
*Attorney, Agent, or Firm*—Varndell & Varndell, PLLC

[57] ABSTRACT

In a centrifugal separating method using connected tube assemblies in which a plurality of tubes are connected to each other, the connected tube assemblies that have been used in a previous process are mounted in a centrifugal machine as they have been to perform centrifugal separation, and are used as they are in a subsequent process. In a centrifugal machine, the rotor is formed with a plurality of holes arranged in straight line, each of the holes receiving and supporting one of a plurality of tubes of the connected tube assembly Alternatively, the rotor is formed with a straight or arc-shaped long hole for receiving and supporting two or more tubes of a plurality of tubes of the connected tube assembly.

6 Claims, 5 Drawing Sheets

CENTRIFUGAL SEPARATING METHOD AND CENTRIFUGAL MACHINE

FIELD OF THE INVENTION AND RELATED ART STATEMENT

The present invention relates to a centrifugal separating method and a centrifugal machine (centrifugal separator) preferably used for working the centrifugal separating method.

Centrifugal machines are used in a variety of fields. For example, in the field of genetic engineering, the polymerase chain reaction (PCR) method requires the purification process for DNA and RNA as a pretreatment process for the amplification of DNA and RNA. In the purification process, a sample is placed in a container called "tube" into which a reagent such as ethanol is added. The content of the tube containing the sample and the reagent is subjected to centrifugal separation by using a centrifugal separator. As a result of the centrifugal separation, supernatant liquid is produced. After removing the supernatant liquid and adding again the reagent into the tube, the centrifugal separation is again performed to the content of the tube. After repeating the centrifugal separation several times, the tube is mounted in a amplification device for amplifying DNA and RNA.

Referring to FIG. 5, the purification process is now described. A large number of tubes 2 are placed in a tray 1, a sample is put into each of the tubes 2 and ethanol is added thereto, and a cap 3 is put on each of the tubes 2. Then, the tubes 2 are taken out from the tray 1 one by one to mount them into tube mounting holes 6 formed in a rotor 5 of a centrifugal separator 4, and centrifugal separation is performed by rotating the rotor 5. Thereafter, the tubes 2 are taken out from the tube mounting holes 6 one by one to place them back into the tray 1, the caps 3 are taken off, supernatant liquid is removed from the tubes by using a pipet or the like, and reagent is added. After repeating the above-described operations several times, the tubes 2 are finally placed in the tray, the supernatant liquid is removed, and the tubes 2 are mounted in a amplification device 7.

In the above-described conventional purification process for DNA and RNA, tubes 2 are moved from the tray 1 to mount them in the tube mounting holes 6 of the rotor 5 of the centrifugal separator 4 one by one, and then moved from the tube mounting holes 6 to the tray 1 one by one. This conventional operations were extremely troublesome. This is partially because the tubes 2 were separately formed, and the tube mounting holes 6 were arranged in a circle with the center thereof coinciding with the center of the rotor 5 in order to apply the equal centrifugal force to each of the tubes 2.

At present, a connected tube assembly is available which is made of plastic material in which a plurality of tubes 2 are connected to each other. However, when such a connected tube assembly is used in the above-described purification process, the connected tube assembly 2 is separated into each tube prior to the operations in the purification process.

OBJECT AND SUMMARY OF THE INVENTION

Accordingly, an object of the present invention is to provide a centrifugal separating method and a centrifugal separator capable of improving the efficiency of the operations including the centrifugal separation.

The centrifugal separating method of the present invention is characterized in that the connected tube assemblies that have been used in a previous process are mounted as they have been in the centrifugal separator process to perform centrifugal separation, and after the centrifugal separation process, the connected tube assemblies are used as they are in a subsequent process.

For supporting the connected tube assembly in the centrifugal separator of the present invention, a plurality of tube mounting holes each receiving one tube are formed in line in the rotor of the separator. Alternatively, the tube mounting hole is designed in the shape of a straight long hole or in arc-shaped hole so that a single hole can receive plural tubes of the connected tube assembly.

The centrifugal separating method and the centrifugal separator of the present invention are used preferably in the purification process, examination process and so on, and are suited in the situations where all processes can be preformed without separating the connected tube assembly into each tube.

It is preferable that the rotor of the centrifugal separator of the present invention is made of stainless steel because of its high resistance to medicine. Alternatively, the rotor may be made of other materials such as plastic or aluminum. If the rotor is made of aluminum, it is preferable to perform alumite treatment so as to enhance corrosion resistance. Further, it is preferable that the rotor is made of plastic that is formed by injection molding. The rotor can also be made of stainless steel or aluminum that is formed by a press, etc. It is preferable that the rotor is in the shape which is symmetric with the rotation center point thereof in order to secure balance during its rotation. Thus, the shape of the rotor is preferably circle, square, regular triangle and other regular polygons.

It is preferable that the tube mounting holes formed in the rotor correspond to the connection outline of the connected tube assembly. Since the connected tube assembly is normally arranged in straight line, the tube mounting holes are formed in straight line. However, when tubes are connected to each other in a flexible manner, it is preferable to arrange the holes in arc. In this case, it is preferable that the arc have a radius of curvature that is 35 mm or longer so that mounting of the tubes into the holes is not troublesome.

The tube mounting holes may by formed such that each hole corresponds to respective tube of the connected tube assembly. Alternatively, the tube mounting hole may be designed to have a long opening so that a few of the adjacent tubes in the connected tube assembly can be mounted in a single hole. In the case where the connected tube assembly is constituted by eight tubes, the tube mounting hole may have an opening long enough to receive the all of the tubes (i.e., 8 tubes) in a single hole if sufficient tube holding strength is obtained. To increase the tube holding strength, it may be so designed that the tube mounting hole has an opening for receiving four tubes and two such holes are provided so that all tubes in the connected tube assembly may be mounted in the two holes. To further increase the tube holding force, it may be so designed that three or more holes are provided to receive all tubes in the connected tube assembly.

Although it is preferable that the rotor is in the shape which is symmetric with the rotation center point thereof in order to secure balance during its rotation, the rotor may have other shapes.

Although the connected tube assembly is normally made of plastics, it may be made of other materials.

DETAILED DESCRIPTION OF PREFERRED EMBODIMENTS

Figure 1:
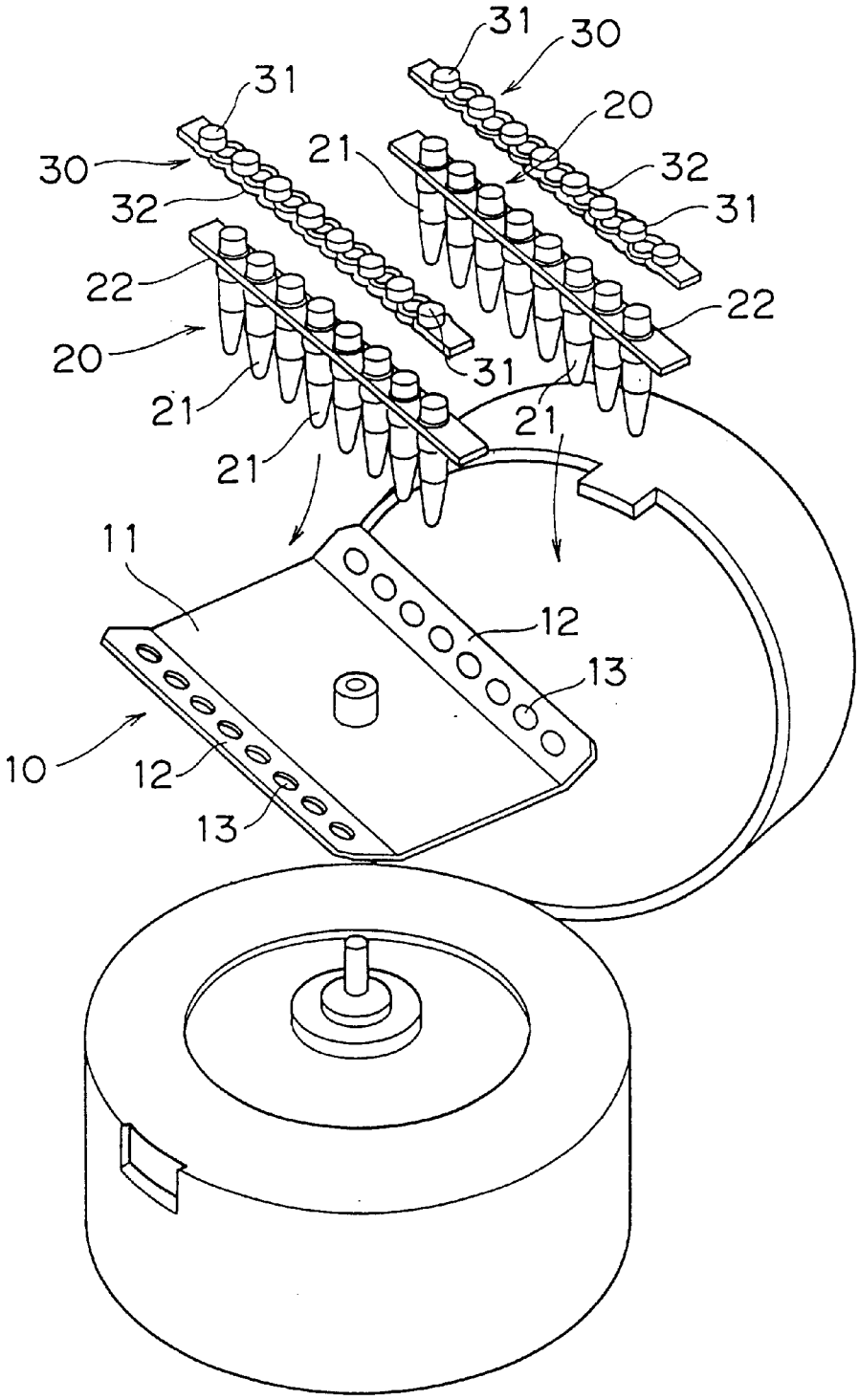
FIG. 1 is a perspective view illustrating a centrifugal separator and its rotor according to one embodiment of the present invention together with a connected tube assembly and a cap assembly.

FIG. 1 shows a rotor 10 of rectangular shape. In the rotor 10, longitudinal edge portions 12 are bent upward with an angle of 30 to 45 degrees relative to a central flat portion 11. The edge portions 12 are formed with a plurality of (eight in this embodiment) tube mounting holes 13 arranged in straight line.

Meanwhile, in the centrifugal separator according to the present invention, a connected tube assembly 20 is used. In the connected tube assembly 20, a plurality of tubes 21 (eight tubes in this embodiment) are connected to each other by means of a rib (holder) 22. A cap assembly 30 is provided for the connected tube assembly 20. In the cap assembly 30, a plurality of caps 31 (the number corresponding to the number of tubes in the connected tube assembly) are connected to each other by means of a rib 32.

Figure 5:
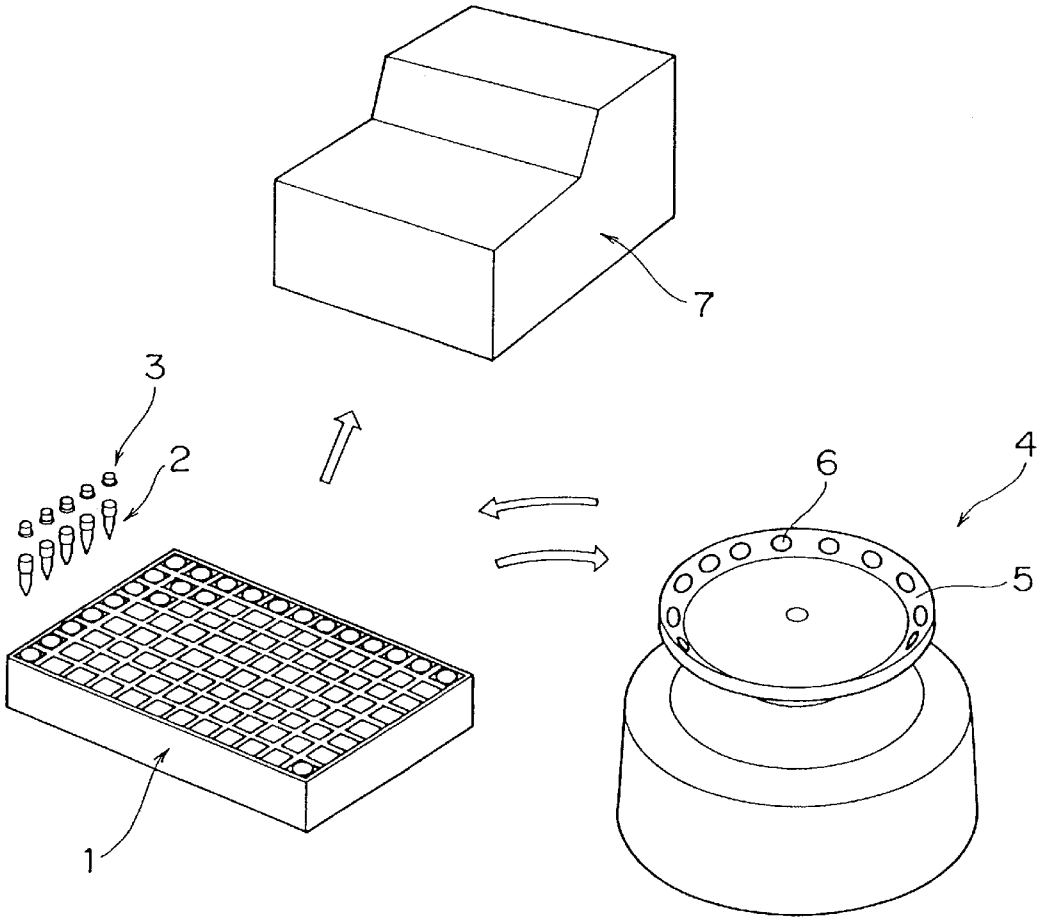
Fig. 5 PRIOR ART
FIG. 5 is a perspective view generally illustrating purification operations for DNA and RNA using a conventional centrifugal separator.

In performing the purification for DNA and RNA, the connected tube assembly 20 is placed in a tray 1 (FIG. 5), a sample is put into each of the tubes 21 to which and ethanol is added, and the cap assembly 30 is put on the connected tube assembly 20. Then, the connected tube assembly 20 is taken out from the tray 1, and in turn is placed into the tube mounting holes 13 formed in the rotor 10. Then, centrifugal separation is performed by rotating the rotor 10. Thereafter, the connected tube assembly 20 is taken out form the rotor 10 to place them into the tray 1, the cap assembly 30 is taken off, and supernatant liquid produced during the centrifugal separation is removed by means of a pipet. After the above-mentioned operations have been repeated several times, the connected tube assembly 20 is finally placed in the tray 1, supernatant liquid is removed, and the cap assembly 30 is put on the connected tube assembly 20. Thereafter, the connected tube assembly 20 is moved to the amplification device 7 (FIG. 5).

As described above, in the centrifugal separator according to this invention, the connected tube assembly 20 can be handled as it is in the purification process for DNA and RNA without separating the tubes 21 from each other. Therefore, the operations involved in the purification process become easier.

Figure 2A:
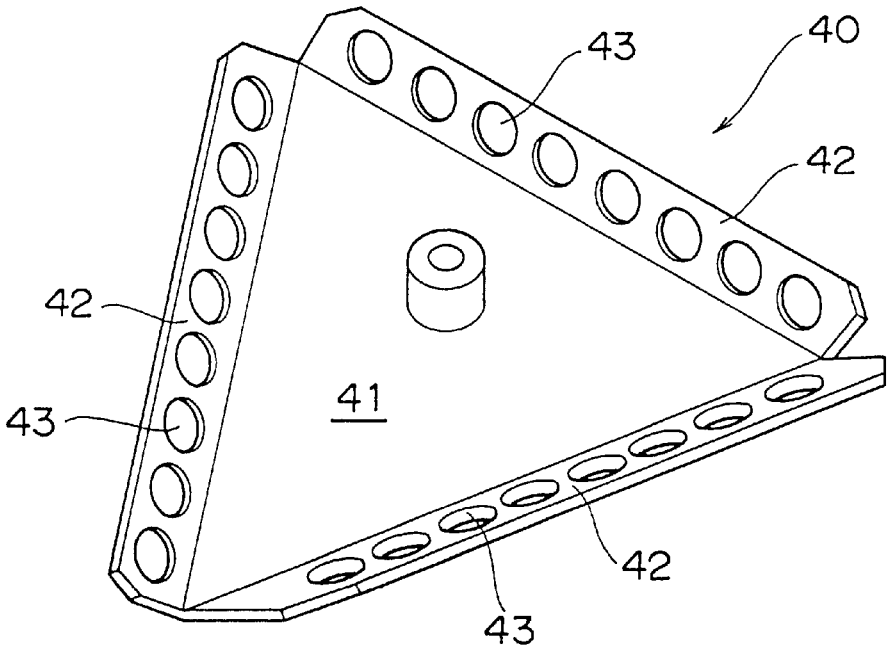
FIG. 2*a* is a perspective view illustrating another embodiment of the rotor of the centrifugal separator.
Figure 2B:
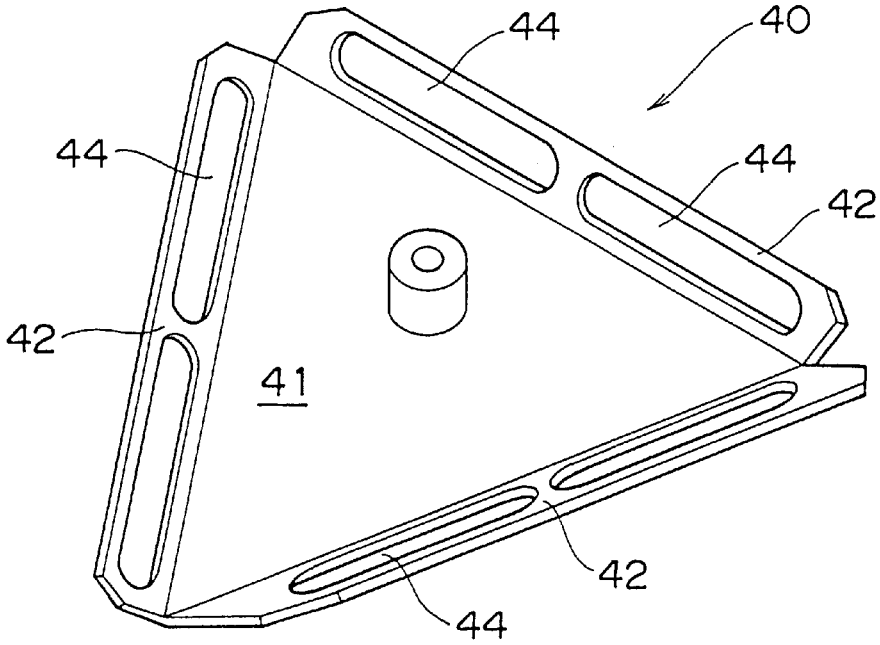
FIG. 2*b* is a perspective view illustrating a modification of the rotor shown in FIG. 2*a;*

Referring to FIG. 2 that illustrates another embodiment of the rotor. A rotor 40 in this embodiment has a shape of regular triangle. Each of edge portions 42 of the triangle is bent upward with an angle of 30 to 45 degrees relative to a central flat portion 41. The edge portions 42 are formed with a plurality of (eight in this embodiment) tube mounting holes 43 arranged in straight line. In a modified rotor 40 as shown in FIG. 2*b*, the tube mounting holes 43 in FIG. 2*a* are elongated into long holes 44.

Figure 3A:
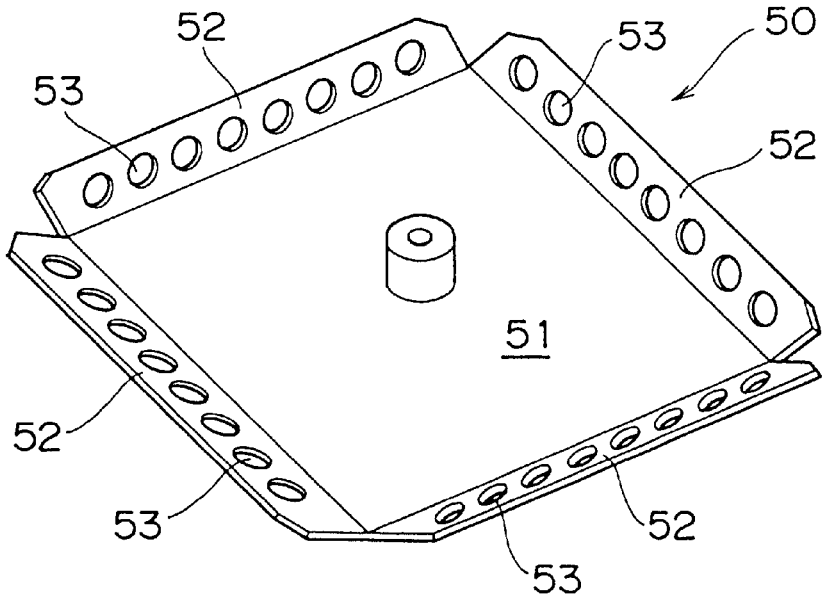
FIG. 3*a* is a perspective view illustrating still another embodiment of the rotor of the centrifugal separator according to the present invention.
Figure 3B:
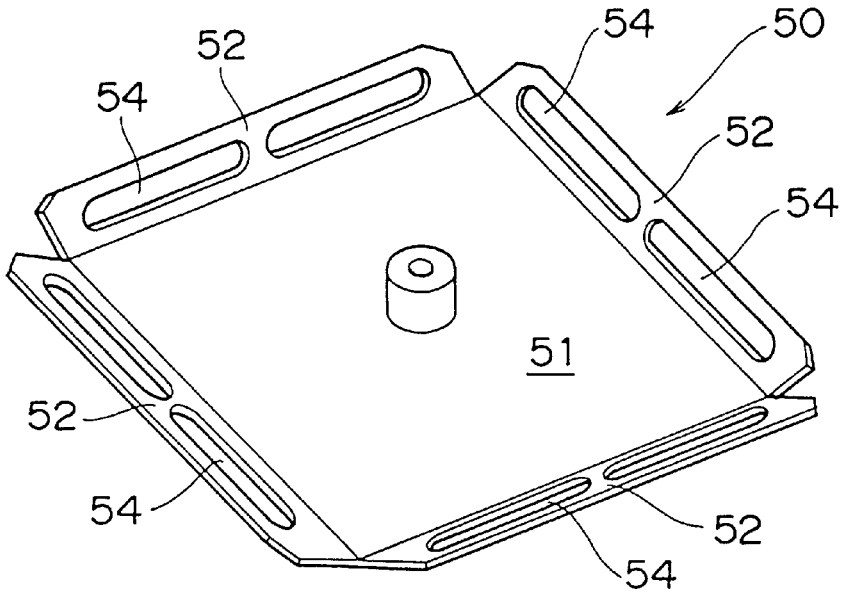
FIG. 3*b* is a perspective view illustrating a modification of the rotor shown in FIG. 3*a;*

Referring to FIG. 3*a* that illustrates still another embodiment of the rotor. A rotor 50 in this embodiment has a shape of square. Each of edge portions 52 of the square is bent upward with an angle of 30 to 45 degrees relative to a central flat portion 51. The edge portions 52 are formed with a plurality of (eight in this embodiment) tube mounting holes 53 arranged in straight line. In a modified rotor 50 as shown in FIG. 3*b*, the tube mounting holes 53 in FIG. 3*a* are elongated into long holes 54.

Figure 4:
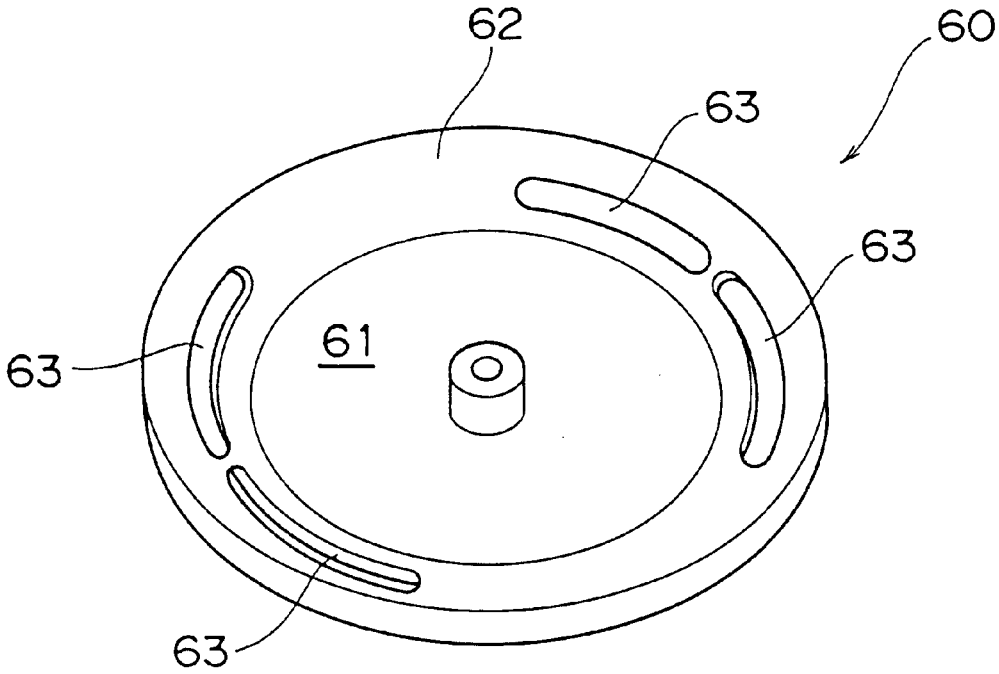
FIG. 4 is a perspective view illustrating yet another embodiment of the rotor of the centrifugal separator according to the present invention.

Referring to FIG. 4 that illustrates yet another embodiment of the rotor. A rotor 60 in this embodiment has a shape of circle. Peripheral portion 62 of the circle is bent upward with an angle of 30 to 45 degrees relative to a central flat portion 61. The peripheral portion 62 is formed with a plurality of (four in this embodiment) tube mounting holes 63 in arc shape. Each of the arc-shaped holes 63 can receive four tubes 21 in the connected tube assembly 20.

As described above, in the centrifugal separating method according to the present invention, centrifugal separation is performed by mounting the connected tube assemblies as they are in the centrifugal separator, operational efficiency is very high.

Also, in the centrifugal separator according to the present invention, as the connected tube assemblies can be mounted as they are, operational efficiency is very high.

What is claimed is:

1. A centrifugal separating method which comprises performing centrifugal separation using a connected tube assembly that is mounted in a centrifugal machine, the connected tube assembly constructed for use in a previous centrifugal separating method and for use in a subsequent centrifugal separating method, wherein the connected tube assembly is placed on a rotor, the rotor having a plurality of mounting holes arranged in a straight line, each of the mounting holes receiving and supporting one of a plurality of tubes, and the tubes are connected to each other.

2. A centrifugal separating method comprising use of a connected tube assembly in which a plurality of tubes are connected to each other by a holder, wherein the connected tube assembly that has been used in a previous centrifugal separation process is placed on a rotor, the rotor having a straight long hole for receiving and supporting two or more tubes of the plurality of tubes, the rotor is mounted in a centrifugal machine and rotated, a present centrifugal separation process is performed, and the connected tube assembly is removed from the centrifugal machine and is used without change in a subsequent centrifugal separation process.

3. A centrifugal separating method comprising use of a connected tube assembly in which a plurality of tubes are connected to each other by a holder, wherein the connected tube assembly that has been used in a previous centrifugal separation process is placed on a rotor, the rotor having a long hole in an arc shape for receiving and supporting two or more tubes of the plurality of tubes, the rotor is mounted in a centrifugal machine and rotated, a present centrifugal separation process is performed, and the connected tube assembly is removed from the centrifugal machine and is used without change in a subsequent centrifugal separation process.

4. A centrifugal separating method, which comprises inserting a plurality of tubes into a holder and thereby providing a connected tube assembly where the tubes are connected to each other by the holder, wherein the connected tube assembly is placed on a rotor, the rotor having a plurality of mounting holes arranged in a straight line, each of the mounting holes receiving and supporting at least one tube of the plurality of tubes, and the rotor is placed in a centrifugal machine and rotated, and using the connected tube assembly in successive centrifugal separation processes without separating the tubes from the holder.

5. A centrifugal separating method, which comprises inserting a plurality of tubes into a holder and thereby providing a connected tube assembly where the tubes are connected to each other by the holder, wherein the connected tube assembly is placed on a rotor, the rotor having a straight long hole for receiving and supporting two or more tubes of the plurality of tubes, and the rotor is placed in a centrifugal machine and rotated, and using the connected tube assembly in successive centrifugal separation processes without separating the tubes from the holder.

6. A centrifugal separating method, which comprises inserting a plurality of tubes into a holder and thereby providing a connected tube assembly where the tubes are connected to each other by the holder, wherein the connected tube assembly is placed on a rotor and the rotor is placed in a centrifugal machine and rotated, the rotor having a long hole in an arc shape for receiving and supporting two or more tubes of the plurality of tubes, and using the connected tube assembly in successive centrifugal separation processes without separating the tubes from the holder.

* * * * *